US009624859B2

(12) United States Patent
Kamioka et al.

(10) Patent No.: US 9,624,859 B2
(45) Date of Patent: Apr. 18, 2017

(54) ENGINE STOP CONTROL APPARATUS AND ENGINE STOP CONTROL METHOD

(71) Applicant: Mitsubishi Electric Corporation, Tokyo (JP)

(72) Inventors: Nozomu Kamioka, Tokyo (JP); Satoshi Wachi, Tokyo (JP); Toshiaki Date, Tokyo (JP); Noriya Sagayama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 71 days.

(21) Appl. No.: 14/768,274

(22) PCT Filed: Apr. 22, 2013

(86) PCT No.: PCT/JP2013/061764

§ 371 (c)(1),
(2) Date: Aug. 17, 2015

(87) PCT Pub. No.: WO2014/174567

PCT Pub. Date: Oct. 30, 2014

(65) Prior Publication Data

US 2015/0377162 A1 Dec. 31, 2015

(51) Int. Cl.
*F02N 19/00* (2010.01)
*F02D 41/04* (2006.01)
(Continued)

(52) U.S. Cl.
CPC ..... *F02D 41/042* (2013.01); *F02D 29/02* (2013.01); *F02D 29/06* (2013.01); *F02N 11/04* (2013.01);
(Continued)

(58) Field of Classification Search
CPC ..... F02D 41/042; F02D 29/06; F02N 11/04; F02N 11/08; F02N 2200/021;
(Continued)

(56) References Cited

U.S. PATENT DOCUMENTS

2005/0211194 A1 9/2005 Hanson et al.
2006/0186862 A1 8/2006 Takahashi

FOREIGN PATENT DOCUMENTS

JP 2001-027171 A 1/2001
JP 2001-193540 A 7/2001
(Continued)

OTHER PUBLICATIONS

International Search Report for PCT/JP2013/061764 dated May 21, 2013.

*Primary Examiner* — Hai Huynh
(74) *Attorney, Agent, or Firm* — Sughrue Mion, PLLC; Richard C. Turner

(57) ABSTRACT

An engine stopping section first selects, when an engine stop condition is satisfied, a power-generation braking mode in which a power-generation braking torque is applied to the engine by a power generation operation of the generator, to thereby apply the power-generation braking torque to the engine, and then selects a short-circuit braking mode in which a short-circuit braking torque is applied to the engine by short-circuiting each energization phase of an armature coil with a semiconductor switch and by causing a field current to flow through a field coil, to thereby apply the short-circuit braking torque to the engine.

9 Claims, 8 Drawing Sheets

(51) Int. Cl.

| | |
|---|---|
| ***F02D 29/02*** | (2006.01) |
| ***F02D 29/06*** | (2006.01) |
| ***F02N 11/04*** | (2006.01) |
| *F02N 11/08* | (2006.01) |

(52) U.S. Cl.
CPC ..... *F02N 19/005* (2013.01); *F02D 2250/06* (2013.01); *F02N 2011/0896* (2013.01); *F02N 2019/008* (2013.01); *F02N 2200/021* (2013.01)

(58) Field of Classification Search
CPC ..... F02N 2011/0896; F02N 2250/06; F02N 19/005; F02N 2019/008; F01L 13/04; F01L 13/06
USPC ..... 123/179.3, 179.4, 320; 701/112, 113; 290/31, 34, 36 R, 38 R, 40 R
See application file for complete search history.

(56) References Cited

FOREIGN PATENT DOCUMENTS

| | | | |
|---|---|---|---|
| JP | 2004-251252 | A | 9/2004 |
| JP | 2004-278315 | A | 10/2004 |
| JP | 2005-282574 | A | 10/2005 |
| JP | 2006-170068 | A | 6/2006 |
| JP | 2006-238506 | A | 9/2006 |
| JP | 2008-137550 | A | 6/2008 |
| JP | 2009-219232 | A | 9/2009 |
| JP | 2010-043532 | A | 2/2010 |

ENGINE STOP CONTROL APPARATUS AND ENGINE STOP CONTROL METHOD

CROSS REFERENCE TO RELATED APPLICATIONS

This application is a National Stage of International Application No. PCT/JP2013/061764 filed Apr. 22, 2013, the contents of all of which are incorporated herein by reference in their entirety.

TECHNICAL FIELD

The present invention relates to an engine stop control apparatus and an engine stop control method, which are to be applied to a vehicle having an idle reduction function in which, when a predetermined engine stop condition is satisfied while the vehicle is traveling, fuel supply to an engine is stopped, and, when a predetermined engine restart condition is satisfied thereafter, the number of revolutions of the engine is increased with use of a starting device to restart the fuel supply to the engine.

BACKGROUND ART

In a vehicle having an idle reduction function, when engine restart is requested through a driver's driving operation, quick performance of restarting the engine instantly is required. At this time, fuel is injected into a cylinder in a stopped state in an expansion stroke to enable quick restart. It is known that stopping the engine in a specific crank angle range among crank angle ranges in the expansion stroke improves the restarting performance.

In view of this, it is necessary to control the engine stop position to an appropriate position, but the number of revolutions of the engine constantly varies due to pumping of a piston. Further, the rotation reduction behavior (deceleration) differs in each engine due to the friction or the like of the engine. Therefore, there has been a problem in that the engine stop position cannot be accurately controlled to the appropriate position.

As a method for solving such a problem, there have been proposed a method of controlling the engine stop position with use of a power-generation braking torque of a generator (for example, see Patent Literature 1), and a method of controlling the engine stop position with use of a short-circuit braking torque generated by a three-phase short circuit of an armature coil (for example, see Patent Literatures 2 and 3). Note that, details of the controls of Patent Literatures are described later.

Note that, as a type of the generator mounted on the vehicle, there is generally known a generator of a field coil type (synchronous machine type), which is configured to perform a power generation operation by generating an electromotive force through an armature coil with a magnetic flux generated by causing a current to flow through a field coil. Further, there are known two methods for braking the field coil-type generator. One method is power-generation braking using power generation, and the other method is short-circuit braking using a short circuit of the armature coil.

The electromotive force generated in the coil is generally proportional to the speed of the magnetic flux crossing the coil. The generator is rotated in synchronization with the engine via a pulley, and hence the generated voltage of the generator can be increased as the number of revolutions of the engine is increased. Note that, the generator enters a charging state when the generated voltage of the generator is higher than a voltage between terminals of a battery. Therefore, the power generation operation is not carried out when the generated voltage falls below the voltage between the terminals of the battery, and hence no power-generation braking torque is generated.

On the other hand, the torque due to the short-circuit braking is generated by consuming the electromotive force of the armature coil therein. Therefore, the torque is not subjected to the restriction of the battery voltage, and can be generated even in an extremely low rotation range. However, in contrast to a magnet-type generator, which requires no additional power during short-circuit braking because a magnetic flux is constantly generated in a rotator, in the field coil-type generator, it is required to cause a current to flow through the field coil to generate a magnetic flux when the short-circuit braking is carried out. Therefore, excess power is consumed.

Further, because the power-generation braking torque is dependent on the battery voltage and the short-circuit braking torque is independent of the battery voltage, it is understood that braking torque characteristics during a power-generation braking mode and braking torque characteristics during a short-circuit braking mode do not generally match with each other.

Note that, in Patent Literature 1, there is disclosed a method of controlling the stop position with use of the power-generation braking torque. In this method, as described above, a sufficient power-generation braking torque cannot be generated in a low rotation range. Therefore, the power-generation braking torque is controlled so as to be matched with a target number of revolutions for the rotation stop (rotation reduction behavior). With this, the behavior of the number of revolutions in the low rotation range, which is uncontrollable by the power-generation braking torque, is set uniform, thereby stopping the engine in a specific crank angle range.

Further, in Patent Literature 2, there is disclosed a method of controlling the stop position with use of the short-circuit braking torque. In this method, as described above, the short-circuit braking torque is generated also in the low rotation range in which the power-generation braking torque cannot be generated, thereby stopping the engine accurately in the vicinity of the target stop position.

Further, in Patent Literature 3, there is disclosed a method of controlling the stop position with use of the short-circuit braking torque similarly to Patent Literature 2. In this method, when the number of revolutions of the engine is less than a predetermined number of revolutions, an energization phase of a motor is short-circuited to generate a short-circuit braking torque, thereby stopping the engine.

CITATION LIST

Patent Literature

[PTL 1] JP 2010-43532 A
[PTL 2] JP 2001-193540 A
[PTL 3] JP 2008-137550 A

SUMMARY OF INVENTION

Technical Problems

However, the related art has the following problems.

In the invention according to Patent Literature 1, in order to improve the restarting performance, it is necessary to control the above-mentioned crank angle range more accurately. However, the power-generation braking torque cannot be secured in an extremely low rotation range. Therefore, reverse rotation (swing-back) of the engine occurs, and when there is a restart request during the reverse rotation, a larger drive force is necessary than during forward rotation. As a result, there is a problem in that the starting performance is deteriorated.

Further, the invention according to Patent Literature 2 uses the magnet-type motor, which can obtain the short-circuit braking torque by short-circuiting each energization phase. Note that, when the invention according to Patent Literature 2 is applied to the field coil-type generator, a magnetic flux is generated by a field current, and the short-circuit braking torque changes depending on the magnitude of the current. Therefore, the short-circuit braking torque cannot be obtained simply by short-circuiting the energization phase. Further, there is a problem in that it is necessary to appropriately control the field current so that the engine stops its rotation at the target stop position.

Further, in the invention according to Patent Literature 3, when the number of revolutions of the engine is less than a predetermined number of revolutions, the energization phase of the motor is short-circuited to generate the short-circuit braking torque. However, the field coil generally has an inductance component larger than that of the armature coil, and the change in current with respect to the change in voltage has a response lag. Therefore, in the invention according to Patent Literature 3, a response lag is generated from a time when the motor is instructed to generate the short-circuit braking torque to a time when the engine actually stops, which causes a problem in that the engine cannot be promptly stopped.

It is known that a time period required for reaching a desired current from a state in which the field current is flowing is shorter than a time period required for reaching a desired current from a state in which the field current is not flowing. The invention according to Patent Literature 3 uses the magnet-type motor. Therefore, the field coil is absent, and the state of the field current just before switching to the short-circuit braking mode is unclear. Therefore, a response lag may be generated when the invention according to Patent Literature 3 is applied to the field coil-type generator.

Further, the predetermined number of revolutions for switching to the short-circuit braking mode is not set in consideration of the state of the field coil. Therefore, the braking mode may be switched to the short-circuit braking mode even when the engine rotates in the number of revolutions that can generate power. As a result, kinetic energy during deceleration may be wastefully consumed.

The present invention has been made to solve the above-mentioned problems, and has an object to obtain an engine stop control apparatus and an engine stop control method, which use a field coil-type generator, are capable of stopping an engine accurately at a target stop position without causing swing-back, are small in power consumption, and have high energy efficiency.

Solution to Problem

According to one embodiment of the present invention, there is provided an engine stop control apparatus, which is to be applied to a vehicle including an engine controlling section configured to stop fuel supply to an engine to stop the engine when an engine stop condition is satisfied, and then restart the engine when an engine restart condition is satisfied, the engine stop control apparatus including: a generator of a field coil type, which is connected to the engine, the generator being configured to control a field current flowing through a field coil to control a power generation amount, and switch an energization phase of an armature coil with a semiconductor switch; and an engine stopping section configured to switch between a power-generation braking mode in which a power-generation braking torque is applied to the engine by a power generation operation of the generator, and a short-circuit braking mode in which a short-circuit braking torque is applied to the engine by short-circuiting each energization phase of the armature coil with the semiconductor switch and by causing the field current to flow through the field coil, the engine stopping section being configured to, when the engine stop condition is satisfied, first select the power-generation braking mode to apply the power-generation braking torque to the engine, and then select the short-circuit braking mode to apply the short-circuit braking torque to the engine.

Further, according to one embodiment of the present invention, there is provided an engine stop control method, which is to be executed by an engine stop control apparatus applied in a vehicle configured to stop fuel supply to an engine to stop the engine when an engine stop condition is satisfied, and then restart the engine when an engine restart condition is satisfied, the engine stop control method including: selecting, when the engine stop condition is satisfied, a power-generation braking mode in which a power-generation braking torque is applied to the engine by a power generation operation of a generator that is connected to the engine and is configured to control afield current flowing through the field coil to control a power generation amount; and selecting, subsequently to the selecting of the power-generation braking mode, a short-circuit braking mode in which a short-circuit braking torque is applied to the engine by short-circuiting each energization phase of an armature coil of the generator with a semiconductor switch configured to switch the energization phase of the armature coil, and by causing the field current to flow through the field coil.

Advantageous Effects of Invention

According to the engine stop control apparatus of the one embodiment of the present invention, the engine stopping section first selects, when the engine stop condition is satisfied, the power-generation braking mode in which the power-generation braking torque is applied to the engine by the power generation operation of the generator, to thereby apply the power-generation braking torque to the engine, and then selects the short-circuit braking mode in which the short-circuit braking torque is applied to the engine by short-circuiting each energization phase of the armature coil with the semiconductor switch and by causing the field current to flow through the field coil, to thereby apply the short-circuit braking torque to the engine.

Further, the engine stop control method according to the one embodiment of the present invention includes: selecting, when the engine stop condition is satisfied, the power-generation braking mode in which the power-generation braking torque is applied to the engine by the power generation operation of the generator; and selecting, subsequently to the selecting of the power-generation braking mode, the short-circuit braking mode in which the short-circuit braking torque is applied to the engine by short-circuiting each energization phase of the armature coil with the semiconductor switch, and by causing the field current to flow through the field coil.

Accordingly, it is possible to obtain the engine stop control apparatus and the engine stop control method, which are capable of stopping the engine accurately at the target stop position without causing the swing-back, are small in power consumption, and have the high energy efficiency.

DESCRIPTION OF EMBODIMENT

Now, an engine stop control apparatus and an engine stop control method according to an exemplary embodiment of the present invention are described with reference to the drawings, and like or corresponding parts in the respective drawings are denoted by like reference symbols.

First Embodiment

Figure 1:
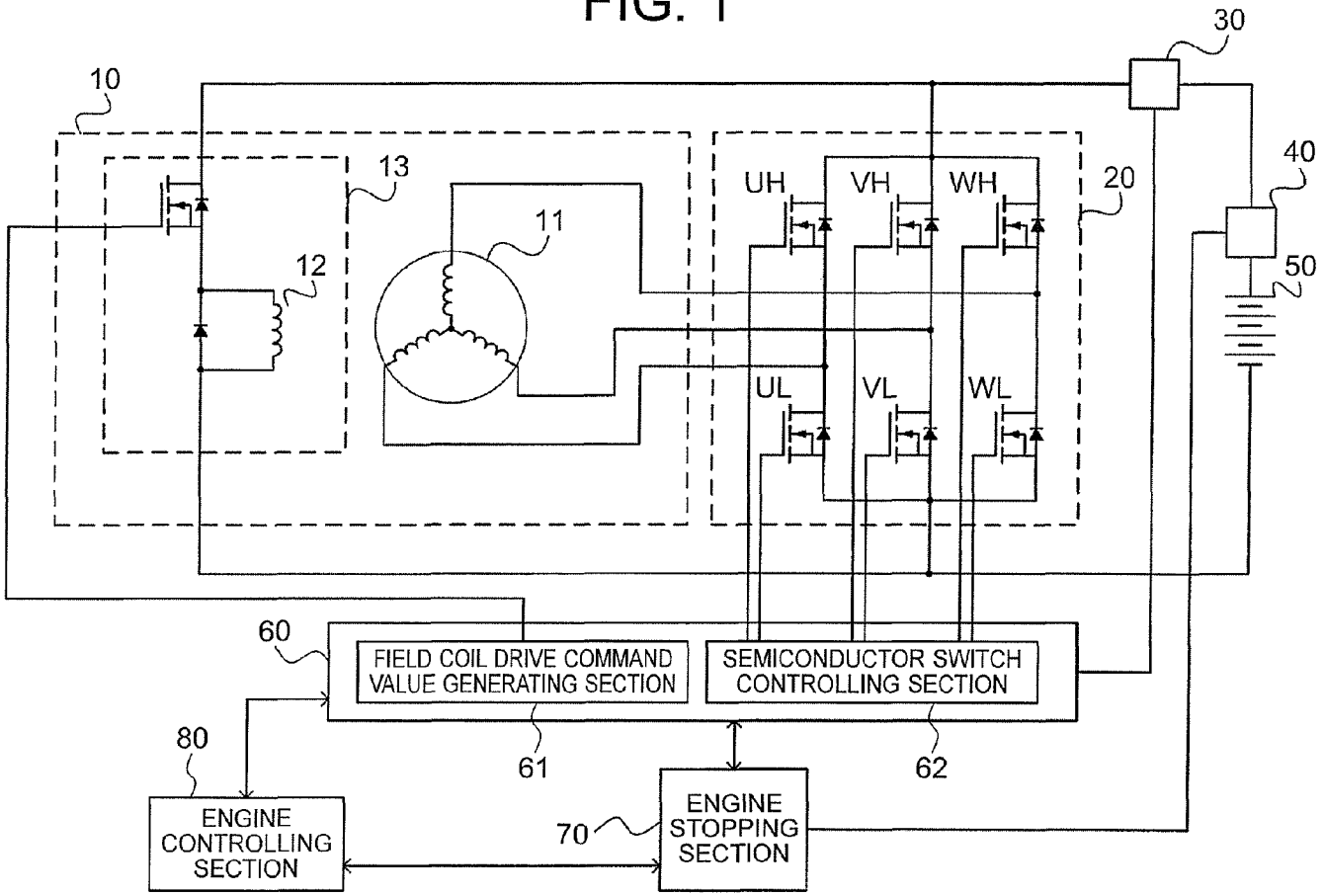
FIG. 1 is a configuration diagram of an engine stop control apparatus according to a first embodiment of the present invention.

FIG. 1 is a configuration diagram of an engine stop control apparatus according to a first embodiment of the present invention. In FIG. 1, the engine stop control apparatus includes a field coil-type generator 10 (hereinafter simply referred to as "generator 10"), an armature coil driving circuit 20, a generator power sensor 30, a battery voltage sensor 40, a battery 50, a generator driving section 60, an engine stopping section 70, and an engine controlling section 80.

The generator 10 includes an armature coil 11, a field coil 12, and a field coil driving circuit 13. The armature coil driving circuit 20 includes six semiconductor switches (UH, VH, WH, UL, VL, and WL). Further, the generator driving section 60 includes a field coil drive command value generating section 61 and a semiconductor switch controlling section 62.

In the generator 10, the armature coil 11 is a stator, and the field coil 12 is a rotator. Further, the energization phase to be energized by the armature coil 11 is switched by the semiconductor switches. The generator 10 controls a field current flowing through the field coil 12 to control a generated voltage or current or a power-generation braking torque, and charges the battery 50 connected to the outside. Note that, a rotation shaft of the generator 10 is connected to an engine (not shown), and is rotated in synchronization with the rotation of the engine. During power generation, part of an engine output is converted into electric power.

In the armature coil 11, when the magnetic flux generated by the current flowing through the field coil 12 interlinks with the armature coil 11, an electromotive force is generated. In this case, the magnitude of the electromotive force is proportional to a change per unit time in which the magnetic flux generated in the field coil 12 interlinks. In other words, as the current flowing through the field coil 12 becomes larger, and further as the number of revolutions of the engine becomes higher, the generated electromotive force becomes larger.

The field coil 12 generates therein a magnetic flux with power from the battery 50. The magnitude of the magnetic flux generated in the field coil 12 is proportional to the magnitude of the current flowing through the field coil 12. In this case, a target value of the magnitude of the current flowing through the field coil 12 is determined by the field coil drive command value generating section 61, and the magnitude of the current flowing through the field coil 12 is controlled by the field coil driving circuit 13 so as to match with this target value.

The armature coil driving circuit 20 is generally called a full-wave rectifying circuit, and is configured to full-wave rectify three-phase AC waveforms generated in the armature coil 11, to thereby enable handing as a direct current. Note that, in general, diodes are used as rectifying elements, but a diode has a large loss during rectification. In view of this, in the armature coil driving circuit 20, instead of the diodes, the semiconductor switches having small loss are turned on or off in accordance with electrical angles of three-phase alternating currents, to thereby enhance the efficiency during rectification.

The generator power sensor 30 is a sensor capable of detecting a terminal voltage and current of the generator 10, and is connected to the generator driving section 60. The battery voltage sensor 40 is a sensor capable of detecting the voltage of the battery 50, and is connected to the engine stopping section 70. The battery 50 is charged by the generator 10, and is connected to a vehicle electrical load in another system (not shown), to thereby supply power to the electrical load.

The generator driving section 60 includes the field coil drive command value generating section 61 and the semiconductor switch controlling section 62, and controls the generator 10 based on a power generation command from the engine controlling section 80 and a braking command (power-generation braking command and short-circuit braking command) from the engine stopping section 70.

The field coil drive command value generating section 61 calculates a target value of the current caused to flow through the field coil 12 based on the power generation command from the engine controlling section 80 and the braking command from the engine stopping section 70.

When the engine controlling section 80 issues the power generation command or the engine stopping section 70 issues the power-generation braking command, the semiconductor switch controlling section 62 instructs, based on the electric angles of the three-phase alternating currents, the semiconductor switches to turn on and off so that the generated power can be taken out as a direct current.

Further, when the engine stopping section 70 issues the short-circuit braking command, the semiconductor switch controlling section 62 turns off the higher semiconductor switches (UH, VH, and WH) and turns on the lower semiconductor switches (UL, VL, and WL), to thereby short-circuit the energization phase of the armature coil 11 (three-phase short circuit). Note that, the higher semiconductor switches may be turned on, and the lower semiconductor switches may be turned off.

The engine stopping section 70 determines an optimum engine stopping method based on, for example, information on the number of revolutions of the engine transmitted from the engine controlling section 80 and information on the voltage output from the battery voltage sensor 40 or the like, and instructs the generator driving section 60 to brake the engine (power-generation braking or short-circuit braking).

The engine controlling section 80 controls, based on information on an accelerator pedal or a shift lever (not shown), for example, the amount of air flowing into the engine, the ignition timing of the engine, the amount of fuel injection, or the like so as to obtain the output requested by the driver or the vehicle, to thereby control the output of the engine.

Further, the engine controlling section 80 stops the fuel injection into the engine when a predetermined engine stop condition (for example, brake depressing operation at a vehicle speed of 15 km/h or less) is satisfied, and rotates the engine by a starter (starting device) (not shown) to restart the fuel injection into the engine when a predetermined engine restart condition (for example, brake releasing operation, accelerator depressing operation, or the like) is satisfied (so-called idle reduction function).

Figure 2:
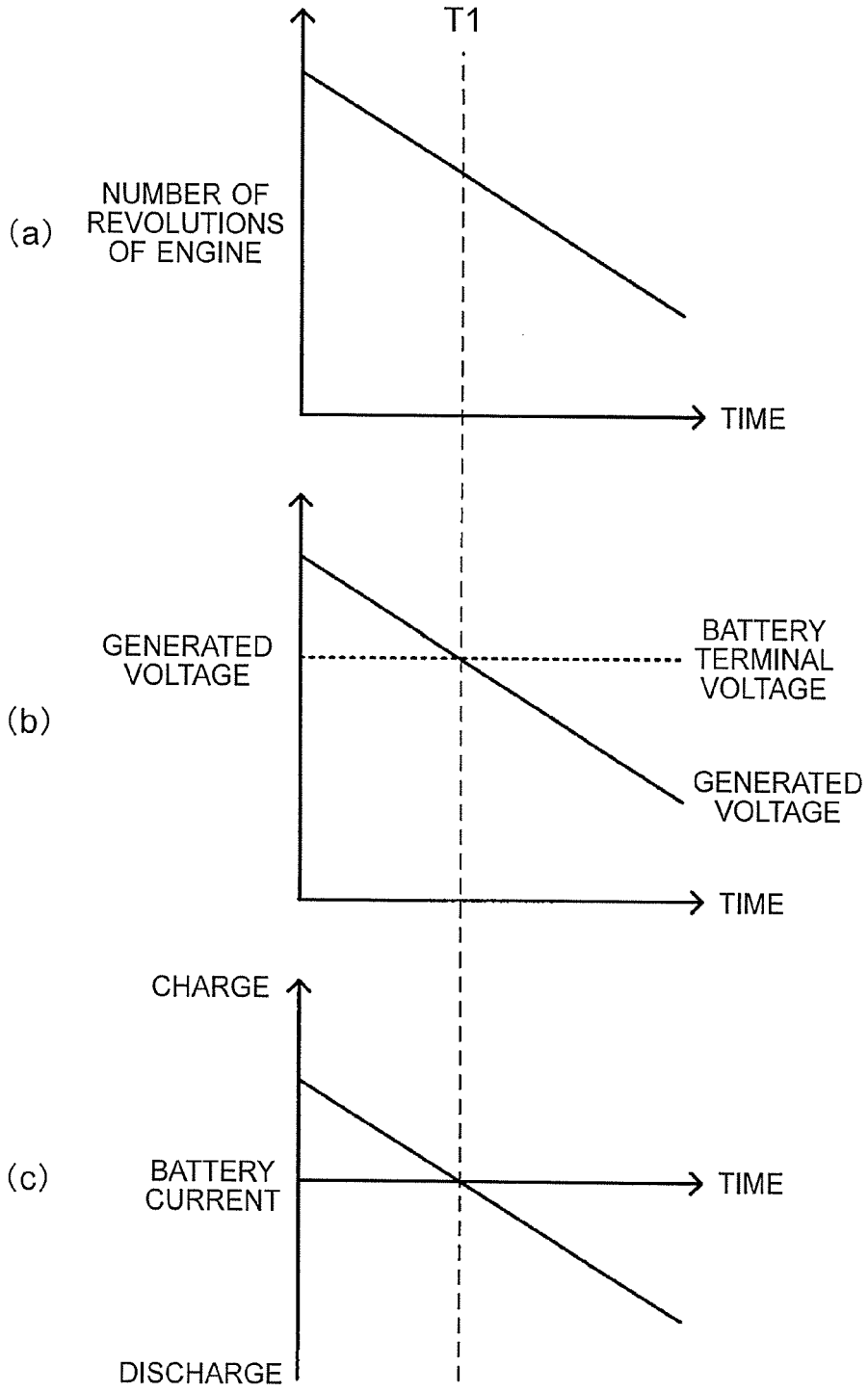
FIGS. 2(*a*) to 2(*c*) are explanatory graphs for showing a relationship between time and each of the number of revolutions of an engine, a generated voltage, and a battery current in the engine stop control apparatus according to the first embodiment of the present invention.

Now, with reference to FIG. 2, the relationship between time and each of the number of revolutions of the engine (FIG. 2(*a*)), the generated voltage (FIG. 2(*b*)), and the battery current (FIG. 2(*c*)) in the engine stop control apparatus according to the first embodiment of the present invention is described.

In FIGS. 2(*a*) to 2(*c*), when the number of revolutions of the engine decreases, the generated voltage of the generator 10 decreases along with the decrease in the number of revolutions of the engine. Further, at a timing T1 at which the generated voltage of the generator 10 falls below a battery terminal voltage, the current flowing through the battery changes from charging to discharging.

Subsequently, with reference to FIGS. 3 and 4, characteristics of the power-generation braking torque and characteristics of the short-circuit braking torque of the generator 10 in the engine stop control apparatus according to the first embodiment of the present invention are described.

Figure 3:
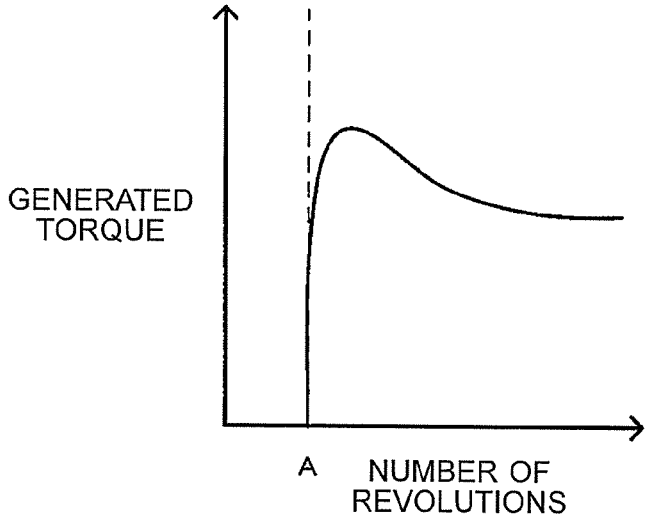
FIG. 3 is an explanatory graph for showing characteristics of a power-generation braking torque of a generator in the engine stop control apparatus according to the first embodiment of the present invention.
Figure 4:
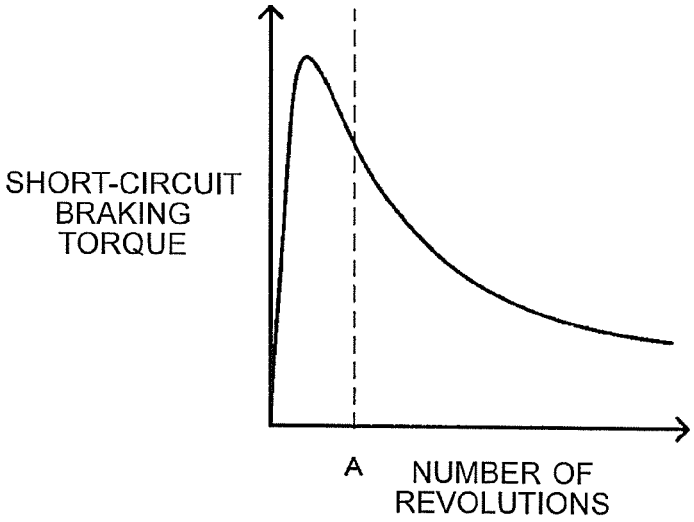
FIG. 4 is an explanatory graph for showing characteristics of a short-circuit braking torque of the generator in the engine stop control apparatus according to the first embodiment of the present invention.

In the characteristics of the power-generation braking torque shown in FIG. 3, in a region in which the number of revolutions is less than A and the generator 10 does not output power to the outside, the braking torque due to the power generation is not generated. Further, in the characteristics of the short-circuit braking torque shown in FIG. 4, even in the region in which the number of revolutions is less than A and the generator 10 does not output power to the outside, the braking torque due to the short circuit is generated. At this time, it is understood that the braking torque is generated from substantially zero rotation.

Figure 5:
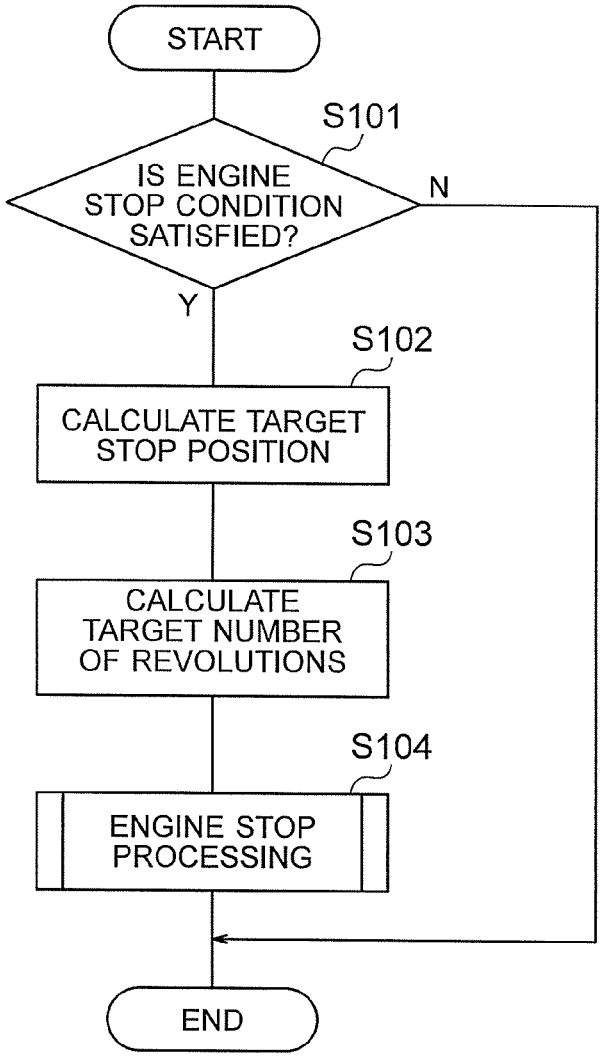
FIG. 5 is a flow chart of control processing of the engine stop control apparatus according to the first embodiment of the present invention.

Next, with reference to the flowchart of FIG. 5, control processing of the engine stop control apparatus according to the first embodiment of the present invention is described. In this case, the processing of FIG. 5 is executed by the engine stopping section 70.

First, whether or not the predetermined engine stop condition is satisfied is determined (Step S101).

In Step S101, when it is determined that the engine stop condition is not satisfied (that is, No), the control processing of FIG. 5 is directly ended.

On the other hand, in Step S101, when it is determined that the engine stop condition is satisfied (that is, Yes), with use of a map of the target stop position, which is set in advance for each range of a predetermined number of revolutions of the engine, the target stop position is calculated (Step S102).

Subsequently, based on the target stop position calculated in Step S102 and a predetermined deceleration set in advance, a target number of revolutions (trajectory thereof) is calculated (Step S103).

Next, the subroutine of the engine stop processing is executed (Step S104), and the control processing of FIG. 5 is ended.

Figure 6:
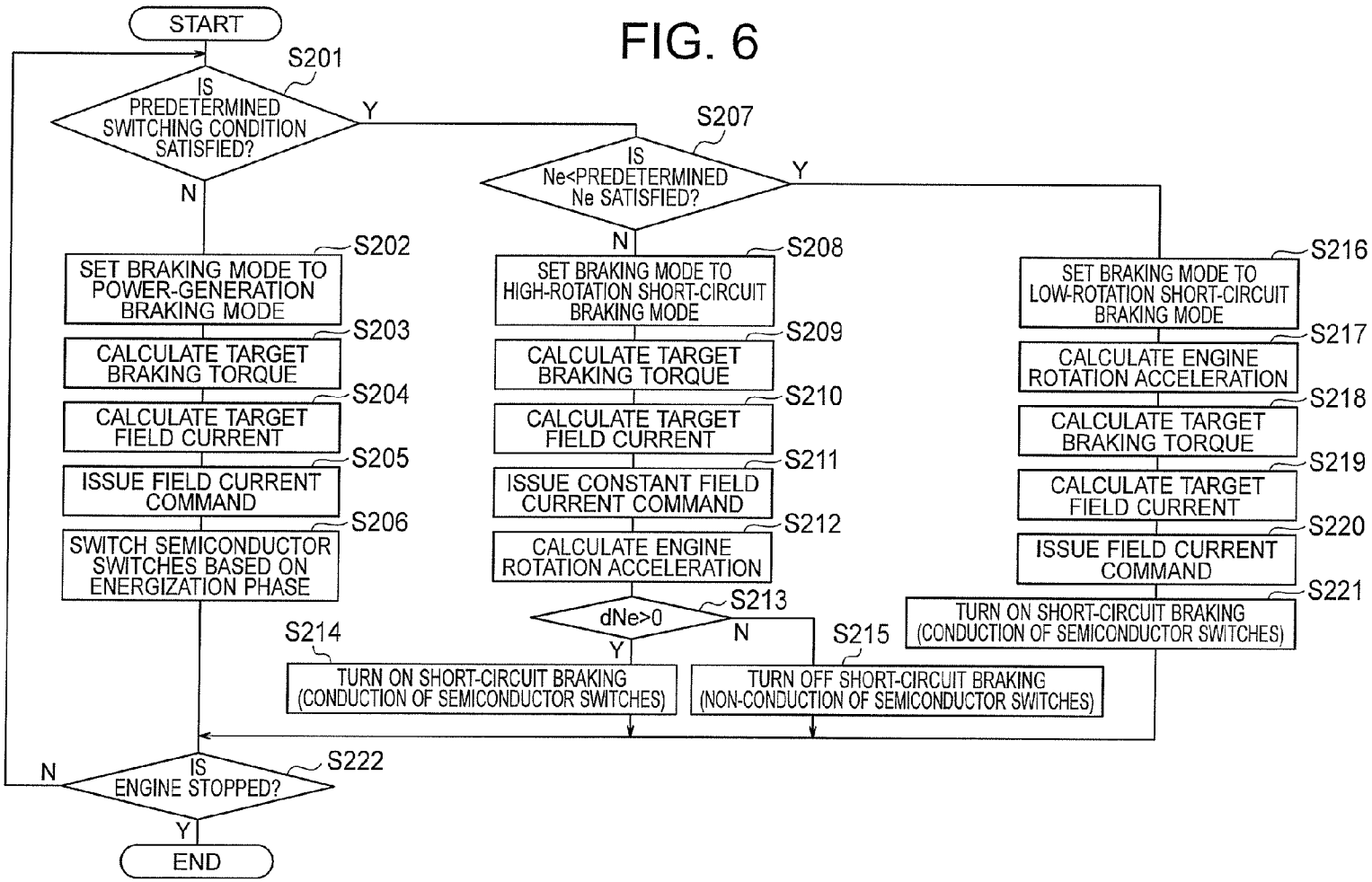
FIG. 6 is a flow chart of a subroutine of engine stop processing of the engine stop control apparatus according to the first embodiment of the present invention.

Subsequently, with reference to the flow chart of FIG. 6, the subroutine of the engine stop processing of the engine stop control apparatus according to the first embodiment of the present invention is described. In this case, the processing of FIG. 6 is executed by the engine stopping section 70 except for the particularly described case.

First, it is determined whether or not a predetermined braking mode switching condition set in advance is satisfied (Step S201).

In Step S201, when it is determined that the braking mode switching condition is not satisfied (that is, No), the braking mode is set to a power-generation braking mode (Step S202).

Note that, specific examples of the braking mode switching condition include a condition that the number of revolutions of the engine is less than a predetermined number of revolutions, and a condition that a current flowing from the generator 10 to the battery 50, which is detected by the generator power sensor 30, falls within a predetermined range in the vicinity of 0 A. Further, the predetermined number of revolutions may be calculated based on an electrical time constant of the field coil 12, or may be the number of revolutions at which, when a rated current is caused to flow through the field coil 12, the generated voltage of the generator 10 detected by the generator power sensor 30 is less than the battery voltage detected by the battery voltage sensor 40.

Next, a difference between the target number of revolutions and the current number of revolutions of the engine is multiplied by an arbitrary predetermined number, to thereby calculate a target braking torque (Step S203).

Subsequently, the field coil drive command value generating section 61 calculates a target field current, which is required to realize the target braking torque calculated in Step S203, based on the above-mentioned characteristics of the power-generation braking torque (Step S204).

Next, the field coil drive command value generating section 61 instructs the field coil driving circuit 13 on the target field current calculated in Step S204 (Step S205).

Subsequently, the semiconductor switch controlling section 62 switches the energization phase with use of the semiconductor switches to carry out the power generation operation (Step S206), and then the processing proceeds to Step S222. At this time, the armature coil driving circuit 20 switches the semiconductor switches based on the command from the semiconductor switch controlling section 62.

On the other hand, in Step S201, when it is determined that the braking mode switching condition is satisfied (that is, Yes), it is determined whether or not the current number of revolutions of the engine (Ne) is less than the number of revolutions for switching the short-circuit braking mode (predetermined Ne set in advance) (Step S207). In this case, the number of revolutions for switching the short-circuit braking mode is calculated based on the electrical time constant of the field coil 12.

In Step S207, when it is determined that the current number of revolutions of the engine is equal to or more than the number of revolutions for switching the short-circuit braking mode (that is, No), the braking mode is set to a high-rotation short-circuit braking mode (Step S208).

Next, a difference between the target number of revolutions and a current average number of revolutions of the engine is multiplied by an arbitrary predetermined number, to thereby calculate the target braking torque (Step S209).

Subsequently, the field coil drive command value generating section 61 calculates the target field current, which is required to realize the target braking torque calculated in Step S208, based on the above-mentioned characteristics of the short-circuit braking torque (Step S210).

Next, the field coil drive command value generating section 61 instructs the field coil driving circuit 13 on the target field current calculated in Step S210 (Step S211). At this time, the field current is controlled to be constant.

Subsequently, a time derivative of the number of revolutions of the engine is obtained to calculate an engine rotation acceleration (dNe) (Step S212).

Next, the sign of the engine rotation acceleration calculated in Step S212 is determined (Step S213).

In Step S213, when it is determined that the engine rotation acceleration is positive (larger than zero) (that is, Yes), the semiconductor switch controlling section 62 short-circuits the energization phase with use of the semiconductor switches so as to carry out the short-circuit braking operation (Step S214), and then the processing proceeds to Step S222. At this time, the armature coil driving circuit 20 switches the semiconductor switches based on the command from the semiconductor switch controlling section 62.

On the other hand, in Step S213, when it is determined that the engine rotation acceleration is negative (equal to or less than zero) (that is, No), the semiconductor switch controlling section 62 opens the circuit with use of the semiconductor switches so as not to carry out the short-circuit braking operation (Step S215), and then the processing proceeds to Step S222. At this time, the armature coil driving circuit 20 switches the semiconductor switches based on the command from the semiconductor switch controlling section 62.

On the other hand, in Step S207, when it is determined that the current number of revolutions of the engine is less than the number of revolutions for switching the short-circuit braking mode (that is, Yes), the braking mode is set to a low-rotation short-circuit braking mode (Step S216).

Subsequently, the time derivative of the number of revolutions of the engine is obtained to calculate the engine rotation acceleration (Step S217).

Next, the difference between the target number of revolutions and the current average number of revolutions of the engine is multiplied by an arbitrary predetermined number, to thereby calculate the target braking torque (Step S218).

Subsequently, the field coil drive command value generating section 61 calculates the target field current, which is required to realize the target braking torque calculated in Step S218, based on the above-mentioned characteristics of the short-circuit braking torque (Step S219).

Next, the field coil drive command value generating section 61 instructs the field coil driving circuit 13 on the target field current calculated in Step S219 (Step S220).

Subsequently, the semiconductor switch controlling section 62 short-circuits the energization phase with use of the semiconductor switches so as to carry out the short-circuit braking operation (Step S221), and then the processing proceeds to Step S222. At this time, the armature coil driving circuit 20 switches the semiconductor switches based on the command from the semiconductor switch controlling section 62.

Next, it is determined whether or not the engine is stopped (Step S222). In this case, the stop of the engine is determined when the engine is rotated within a range of a predetermined number of revolutions arbitrary set in the vicinity of the zero rotation for a predetermined time period set in advance.

In Step S222, when it is determined that the engine is stopped (that is, Yes), the processing of FIG. 6 is ended.

On the other hand, in Step S222, when it is determined that the engine is not stopped (the engine is rotating) (that is, No), the processing returns to Step S201 to repeatedly execute the processing.

Figure 7:
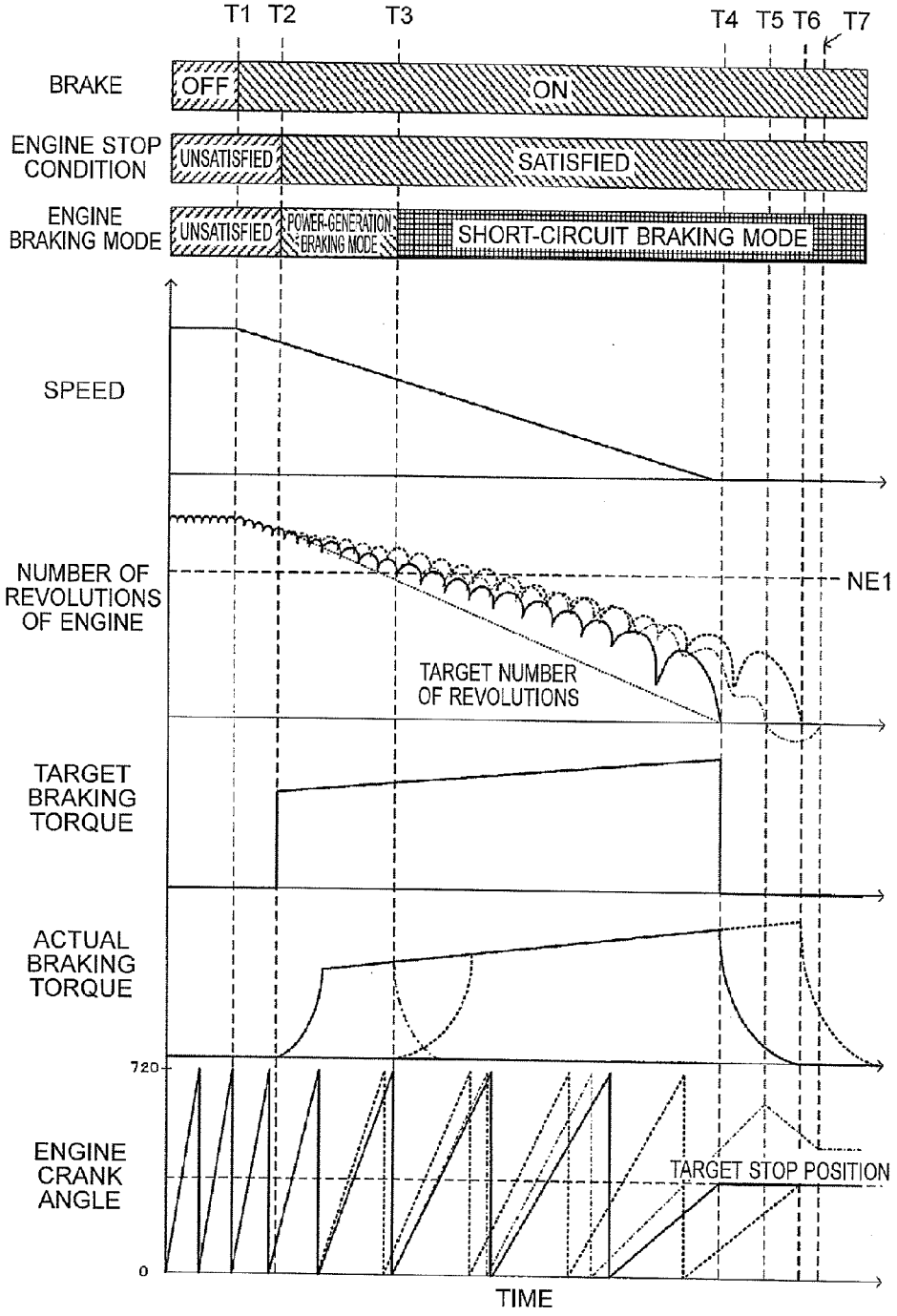
FIG. 7 is a timing chart of processing results of the engine stop control apparatus according to the first embodiment of the present invention.

Now, with reference to the timing chart of FIG. 7, the processing results (flow charts of FIGS. 5 and 6) of the engine stop control apparatus according to the first embodiment of the present invention are described while comparing with a case where the engine stop position is controlled by using only the power-generation braking torque (only in the power-generation braking mode) and a case where the engine stop position is controlled by using only the short-circuit braking (only in the short-circuit braking mode). Note that, regarding the short-circuit braking mode, the high-rotation short-circuit braking mode and the low-rotation short-circuit braking mode represented in Steps S208 and 216 of FIG. 6 are described later with reference to FIGS. 8 and 9.

In FIG. 7, the lateral axis represents time. Further, the vertical axis in FIG. 7 represents, in the order from the top, the driver's brake operation, the engine stop condition calculated in the engine controlling section 80, the engine braking mode calculated in the engine stopping section 70, the speed of the engine, the number of revolutions of the engine, the target braking torque, the actual braking torque, and the engine crank angle.

Further, in FIG. 7, the solid line represents an operation of a case where the engine stop position is controlled by the processing according to the first embodiment of the present invention, the dashed-dotted line represents an operation in the related art in which the engine stop position is controlled with use of only the power-generation braking torque, and the dotted line represents an operation in the related art in which the engine stop position is controlled with use of only the short-circuit braking torque.

First, in a region before a time T1, the brake pedal is not depressed, and the vehicle is coasting.

Subsequently, at the time T1, the driver depresses the brake pedal to start deceleration of the vehicle.

Next, at a time T2, the predetermined engine stop condition is satisfied. At this time, the engine stopping section 70 determines whether or not the predetermined engine braking mode switching condition is satisfied in response to the satisfaction of the engine stop condition transmitted from the engine controlling section 80. As a result, the condition is satisfied, and hence the engine stopping section 70 sets the engine braking mode to the power-generation braking mode.

With this, the vehicle continues the deceleration, and the number of revolutions of the engine also decreases. Simultaneously, the target braking torque is calculated, and the field current rises with a predetermined time constant, to thereby generate the power-generation braking torque. Note that, according to the related art in which the engine stop position is controlled only in the short-circuit braking mode, the braking by the power-generation braking torque is not executed in this region, and hence the decrease in the number of revolutions of the engine is gentler than that in the case where the power-generation braking torque is applied.

Subsequently, at a time T3, the predetermined engine braking mode switching condition is changed from being satisfied to being unsatisfied. As a result, the engine stopping section 70 sets the engine braking mode to the short-circuit braking mode.

With this, the vehicle speed is continued to decelerate, and the decrease in the number of revolutions of the engine is also continued. At this time, the power-generation braking mode is employed just before the switching, and hence the field current already has a constant value. Thus, even when the braking mode is switched to the short-circuit braking mode, the target braking torque can be maintained continuously.

Note that, according to the related art in which the engine stop position is controlled only in the power-generation braking mode, at the time T3, the number of revolutions of the engine falls below the number of revolutions NE1 at the lower limit for power generation, and the power-generation braking torque decreases. Further, after the time T3, the power-generation braking torque cannot be applied. Therefore, the behavior until the engine stop is determined by the inertia rotation of the engine. Thus, the engine is not necessarily stopped in the vicinity of the calculated target stop position.

In contrast, according to the related art in which the engine stop position is controlled only in the short-circuit braking mode from the time T3, no field current flows just before the switching, and hence the field current increases with a predetermined time constant. Therefore, a certain predetermined time period is required to realize the target braking torque. During this period, the number of revolutions of the engine gently transitions toward the target number of revolutions. As a result, the time required to reach the target stop position is lagged.

Next, at a time T4, the engine reaches the target stop position. At this time, the target braking torque is changed to zero, but the field current decreases with a time constant, and hence the braking torque is generated for a certain predetermined period. Therefore, the reverse rotation (swing-back) of the engine does not occur.

Subsequently, at a time T5, the number of revolutions of the engine in the related art in which the engine stop position is controlled only in the power-generation braking mode reaches zero. Note that, during a period from the time T3 to the time T5, no braking torque is applied (the braking torque is not controlled), and hence the stop position during zero rotation is significantly deviated from the target stop position. Further, no braking torque is applied just before the stop of engine rotation, and hence the reverse rotation (swing-back) of the engine occurs.

Next, at a time T6, the number of revolutions of the engine in the related art in which the engine stop position is controlled only in the short-circuit braking mode reaches zero. In this case, the braking torque is applied just before the stop of engine rotation, and hence the stop position during zero rotation is in the vicinity of the target stop position. Further, the reverse rotation of the engine does not occur.

However, the kinetic energy of the vehicle is not converted into power by the power-generation braking mode, and the period of the short-circuit braking mode is longer than the period of the short-circuit braking mode according to the first embodiment of the present invention. Therefore, the energy necessary for braking is larger than that in the first embodiment of the present invention.

Subsequently, at a time T7, the number of revolutions of the engine in the related art in which the engine stop position is controlled only in the power-generation braking mode reaches zero after the reverse rotation. In this case, the engine is reversely rotated, and hence it is understood that, although the engine is closer to the target stop position than the engine crank angle at the time T5, because the braking torque in the vicinity of the target stop position is not controlled, the engine is not stopped in the vicinity of the target stop position.

Figure 8:
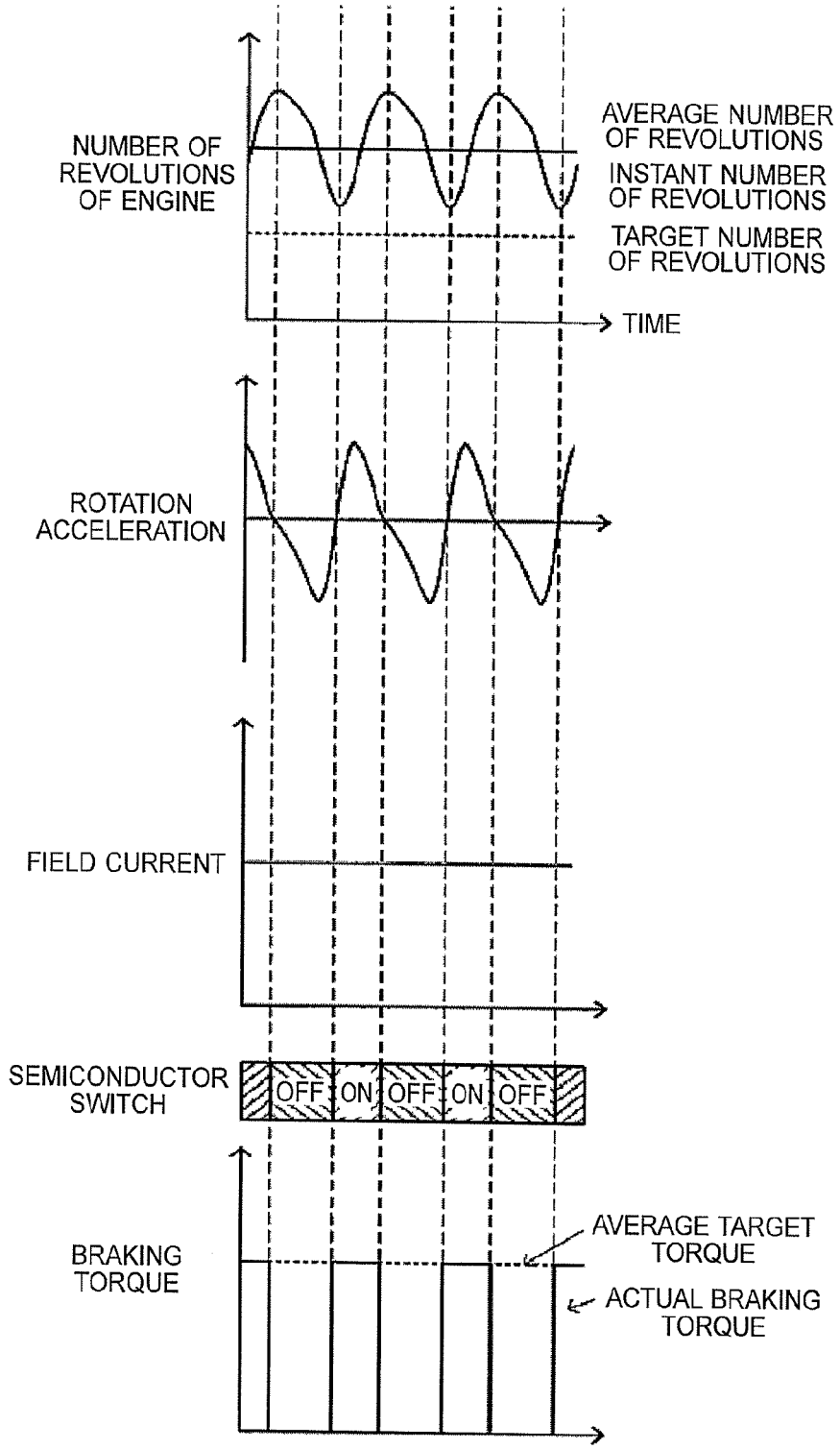
FIG. 8 is a timing chart of a high-rotation short-circuit braking mode in the control processing of the engine stop control apparatus according to the first embodiment of the present invention.
Figure 9:
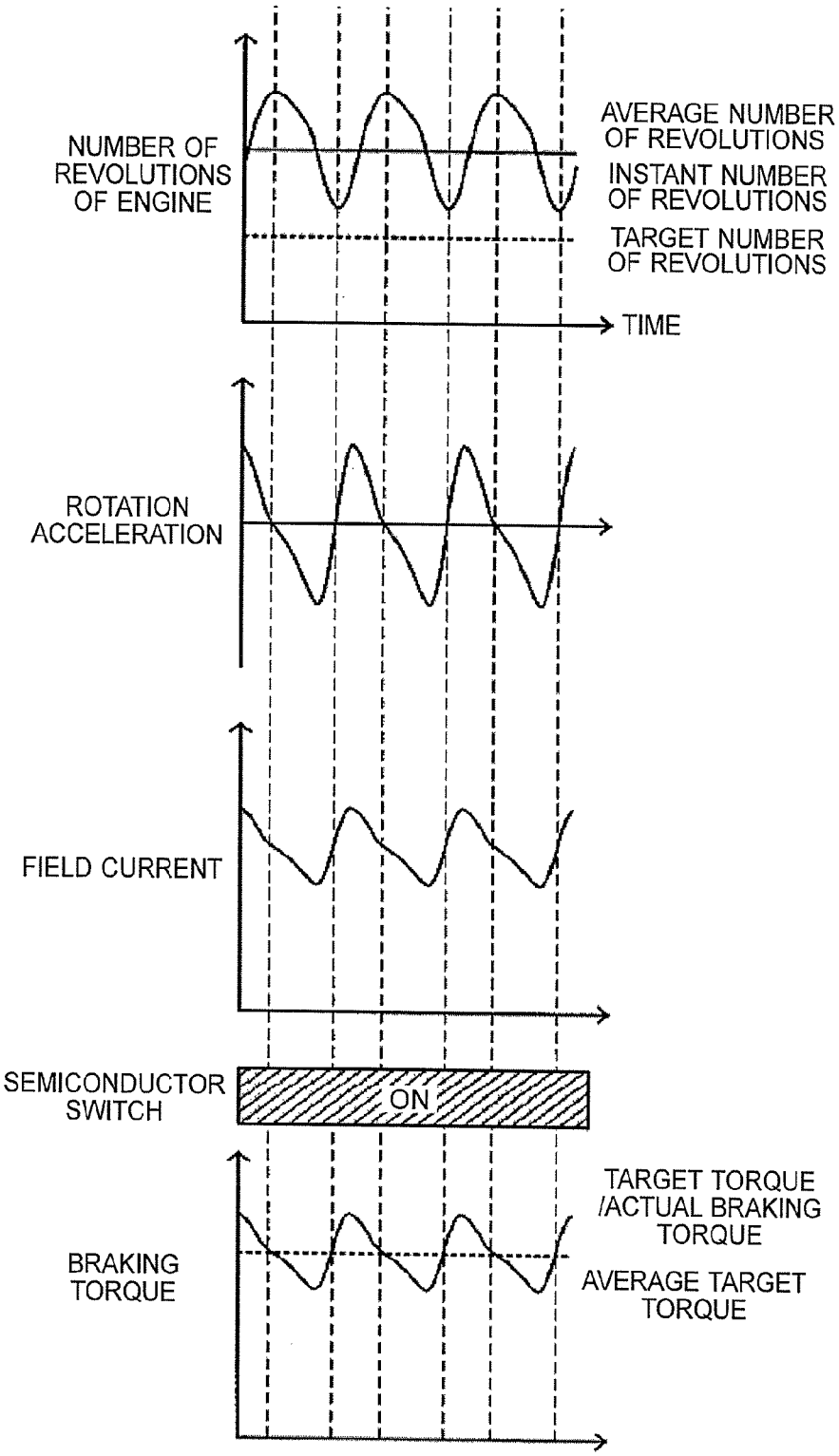
FIG. 9 is a timing chart of a low-rotation short-circuit braking mode in the control processing of the engine stop control apparatus according to the first embodiment of the present invention.

Now, with reference to the timing charts of FIGS. 8 and 9, the high-rotation short-circuit braking mode and the low-rotation short-circuit braking mode represented in Steps S208 and S216 of FIG. 6 in the control processing of the engine stop control apparatus according to the first embodiment of the present invention are described. Note that, in FIG. 8, the high-rotation short-circuit braking mode (vicinity of the time T3 in the short-circuit braking mode shown in FIG. 7) is shown, and in FIG. 9 the low-rotation short-circuit braking mode (vicinity of the time T4 in the short-circuit braking mode shown in FIG. 7) is shown.

In FIGS. 8 and 9, the lateral axis represents time. Further, the vertical axis of FIGS. 8 and 9 represents, in the order from the top, the number of revolutions of the engine, the rotation acceleration, the field current, the semiconductor switch, and the braking torque. Note that, in FIGS. 8 and 9, the target number of revolutions, the target torque, and the actual braking torque are actually represented by oblique lines, but are represented by linear lines for simplification.

In FIG. 8, an instant number of revolutions pulsates with a predetermined width because a vertical motion of a plurality of pistons is converted into a rotational motion. Further, an average number of revolutions is calculated to be in the vicinity of the center of the amplitude.

The rotation acceleration is determined by the differential calculation of the instant number of revolutions. Further, the field current is controlled to have a constant value based on the average target torque (described later) and the characteristics of the short-circuit braking torque.

The semiconductor switches are turned on when the rotation acceleration is positive (three-phase short circuit is executed), and are turned off when the rotation acceleration is negative (circuit is open, no three-phase short circuit). Further, the braking torque is not generated when the semiconductor switches are turned off (circuit is open, no three-phase short circuit), and the braking torque of a predetermined magnitude is generated when the semiconductor switches are turned on (three-phase short circuit is executed).

In this case, during the high-rotation short-circuit braking mode, the field current is constantly caused to flow, and hence the loss of the current is caused whether the three-phase short-circuit braking is turned on or off. The average target torque is determined based on the difference between the average number of revolutions and the target number of revolutions.

In FIG. 9, the instant number of revolutions pulsates with the predetermined width because the vertical motion of the plurality of pistons is converted into the rotational motion. Further, the average number of revolutions is calculated to be in the vicinity of the center of the amplitude.

The rotation acceleration is determined by the differential calculation of the instant number of revolutions. Further, a magnitude of the field current is controlled to a magnitude required for realizing the target torque based on the characteristics of the short-circuit braking torque of the generator 10.

The semiconductor switches are constantly turned on (three-phase short circuit is executed). Further, the braking torque is controlled at a value corresponding to the rotation acceleration. That is, the braking torque increases when the rotation acceleration is positive, and the braking torque decreases when the rotation acceleration is negative.

In this case, the average target torque is determined based on the difference between the average number of revolutions and the target number of revolutions. Further, the target torque is calculated as a value obtained by adding, to the average target torque, a value obtained by multiplying the rotation acceleration by an arbitrary predetermined number.

As described above, according to the first embodiment, the engine stopping section first selects, when the engine stop condition is satisfied, the power-generation braking mode in which the power-generation braking torque is applied to the engine by the power generation operation of the generator, to thereby apply the power-generation braking torque to the engine, and then selects the short-circuit braking mode in which the short-circuit braking torque is applied to the engine by short-circuiting each energization phase of the armature coil with the semiconductor switch and by causing the field current to flow through the field coil, to thereby apply the short-circuit braking torque to the engine.

Therefore, it is possible to obtain the engine stop control apparatus and the engine stop control method, which are capable of stopping the engine accurately at the target stop position without causing swing-back, are small in power consumption, and have high energy efficiency.

That is, the period of the short-circuit braking mode can be shortened as much as possible to suppress the power consumption, and kinetic energy can be collected as electrical energy as much as possible.

Further, the power-generation braking mode and the short-circuit braking mode are combined with each other, and thus switching to the short-circuit braking mode is possible under a state in which the field current is raised. Therefore, high response performance can be realized.

Further, by switching between braking modes having different torque characteristics, the performance of controlling the stop position can be improved in a wide rotation range.

Further, the engine stopping section switches the power-generation braking mode to the short-circuit braking mode when the number of revolutions of the engine is less than the predetermined number of revolutions.

In this case, a general vehicle has a rotation sensor for the engine mounted thereon, and hence the braking mode can be switched at an appropriate timing without adding a special device.

Further, the predetermined number of revolutions is calculated based on the time constant of the field coil.

Therefore, in a region in which a cylinder-to-cylinder period of the engine is longer than the time constant of the field coil, it is possible to prevent unnecessary power consumption and a state in which accurate control is impossible because the stop position control by the short-circuit braking is not effectively functioned.

Further, the predetermined number of revolutions is a number of revolutions at which, when the rated current is caused to flow through the field coil, the generated voltage of the generator is less than the battery voltage of the battery connected to the generator.

Therefore, the power-generation braking mode is maintained until the number of revolutions at the limit for power generation. Therefore, the kinetic energy can be regenerated as power to be stored, and thus high energy efficiency can be realized.

Further, the engine stopping section switches the power-generation braking mode to the short-circuit braking mode when the current flowing from the generator to the battery falls within the predetermined range in the vicinity of 0 A.

In this case, the charged current is directly detected, and thus the power-generation braking mode can be maintained until the last minute. Therefore, the kinetic energy can be regenerated as power to be stored, and thus high energy efficiency can be realized.

Further, the engine stopping section controls the field current so that, after switching to the short-circuit braking mode, the short-circuit braking torque increases as a time elapses.

Therefore, the field current is controlled so that a torque increases in the low rotation range, and thus the swing-back can be prevented.

Further, the engine stopping section is configured to: divide the short-circuit braking mode into the high-rotation short-circuit braking mode in which the field current is controlled to a constant current value and short-circuit braking is switched on and off by the semiconductor switch, and the low-rotation short-circuit braking mode in which the short-circuit braking is set to an on state by the semiconductor switch and the field current is controlled to have a current value that generates a torque that cancels rotational fluctuations of the engine; and switch between the high-rotation short-circuit braking mode and the low-rotation short-circuit braking mode based on the number of revolutions for switching the short-circuit braking mode calculated based on the time constant of the field coil.

Therefore, in the low rotation range, the short-circuit braking using the field current in which the control performance of the braking torque is high is introduced. Thus, the engine can be stopped accurately at the target stop position, and the cylinder-to-cylinder variations can be reduced regardless of the number of revolutions. In this manner, the drivability can be improved.

Further, the number of revolutions for switching the short-circuit braking mode is calculated based on the time constant of the field coil. Thus, the effect of suppressing variations in the number of revolutions of the engine can be enhanced.

Further, the generator is a generator motor.

Therefore, even in a vehicle including a generator motor as the starting device for restart, the present invention is applicable, and the drivability can be improved without a significant hardware change.

The invention claimed is:

1. An engine stop control apparatus, which is to be applied to a vehicle including an engine controlling section configured to stop fuel supply to an engine to stop the engine when an engine stop condition is satisfied, and then restart the engine when an engine restart condition is satisfied, the engine stop control apparatus comprising:

a generator of a field coil type, which is connected to the engine, the generator being configured to control a field current flowing through a field coil to control a power generation amount, and switch an energization phase of an armature coil with a semiconductor switch; and an engine stopping section configured to switch between a power-generation braking mode in which a power-generation braking torque is applied to the engine by a power generation operation of the generator, and a short-circuit braking mode in which a short-circuit braking torque is applied to the engine by short-circuiting each energization phase of the armature coil with the semiconductor switch and by causing the field current to flow through the field coil, the engine stopping section being configured to, when the engine stop condition is satisfied, first select the power-generation braking mode to apply the power-generation braking torque to the engine, and then select the short-circuit braking mode to apply the short-circuit braking torque to the engine.

2. An engine stop control apparatus according to claim 1, wherein the engine stopping section switches the power-generation braking mode to the short-circuit braking mode when a number of revolutions of the engine is less than a predetermined number of revolutions.

3. An engine stop control apparatus according to claim 2, wherein the predetermined number of revolutions is calculated based on a time constant of the field coil.

4. An engine stop control apparatus according to claim 2, wherein the predetermined number of revolutions comprises a number of revolutions at which, when a rated current is caused to flow through the field coil, a generated voltage of the generator is less than a battery voltage of a battery connected to the generator.

5. An engine stop control apparatus according to claim 1, wherein the engine stopping section switches the power-generation braking mode to the short-circuit braking mode when a current flowing from the generator to a battery connected to the generator falls within a predetermined range in a vicinity of 0 A.

6. An engine stop control apparatus according to claim 1, wherein the engine stopping section controls the field current so that, after switching to the short-circuit braking mode, the short-circuit braking torque increases as a time elapses.

7. An engine stop control apparatus according to claim 1, wherein the engine stopping section is configured to:

divide the short-circuit braking mode into a high-rotation short-circuit braking mode in which the field current is controlled to a constant current value and short-circuit braking is switched on and off by the semiconductor switch, and a low-rotation short-circuit braking mode in which the short-circuit braking is set to an on state by the semiconductor switch and the field current is controlled to have a current value that generates a torque that cancels rotational fluctuations of the engine; and select, after switching to the short-circuit braking mode, the high-rotation short-circuit braking mode when the number of revolutions of the engine is equal to or more than a number of revolutions for switching the short-circuit braking mode, which is calculated based on the time constant of the field coil, and select the low-rotation short-circuit braking mode when the number of revolutions of the engine is less than the number of revolutions for switching the short-circuit braking mode.

8. An engine stop control apparatus according to claim 1, wherein the generator comprises a generator motor.

9. An engine stop control method, which is to be executed by an engine stop control apparatus applied in a vehicle configured to stop fuel supply to an engine to stop the engine when an engine stop condition is satisfied, and then restart the engine when an engine restart condition is satisfied, the engine stop control method comprising:

selecting, when the engine stop condition is satisfied, a power-generation braking mode in which a power-generation braking torque is applied to the engine by a power generation operation of a generator that is connected to the engine and is configured to control a field current flowing through the field coil to control a power generation amount; and selecting, subsequently to the selecting of the power-generation braking mode, a short-circuit braking mode in which a short-circuit braking torque is applied to the engine by short-circuiting each energization phase of an armature coil of the generator with a semiconductor switch configured to switch the energization phase of the armature coil, and by causing the field current to flow through the field coil.

* * * * *